United States Patent [19]

Magai

[11] 4,358,709

[45] Nov. 9, 1982

[54] FLUORESCENT LIGHT UNIT WITH DUAL LIGHT LEVELS

[75] Inventor: Donald E. Magai, Cleveland Heights, Ohio

[73] Assignee: General Electric Company, Schenectady, N.Y.

[21] Appl. No.: 218,043

[22] Filed: Dec. 19, 1980

[51] Int. Cl.[3] ..... H05B 41/18

[52] U.S. Cl. ..... 315/99; 315/53; 315/58; 315/100; 315/101; 315/200 R; 315/309; 315/DIG. 5

[58] Field of Search ..... 315/53, 58, 62, 99–101, 315/106, 200 R, 208, 291, 309, DIG. 5

[56] References Cited

U.S. PATENT DOCUMENTS

| | | | |
|---|---|---|---|
| 2,320,424 | 6/1943 | Gates | 315/100 |
| 2,350,462 | 6/1944 | Johns | 362/216 |
| 2,652,483 | 9/1953 | Laidig et al. | 362/216 |
| 2,817,004 | 12/1957 | Baumgartner et al. | 362/216 |
| 3,836,814 | 9/1974 | Rodriquez | 315/51 |
| 3,866,088 | 2/1975 | Kaneda et al. | 315/105 |
| 3,878,431 | 4/1975 | Petrina | 315/199 X |
| 4,178,535 | 12/1979 | Miller | 315/53 |
| 4,270,071 | 5/1981 | Morton | 315/62 |
| 4,284,925 | 8/1981 | Bessone et al. | 315/53 X |

*Primary Examiner*—Eugene R. LaRoche

*Attorney, Agent, or Firm*—Norman C. Fulmer; Philip L. Schlamp; Fred Jacob

[57] ABSTRACT

A screw-in fluorescent light unit having two light levels, for use in a 3-way socket. A reactor ballasts the lamp for high light output, and a resistor is added to ballast the lamp for low light output. A bilateral switch device is connected across the resistor to facilitate lamp starting at the low light output.

6 Claims, 3 Drawing Figures

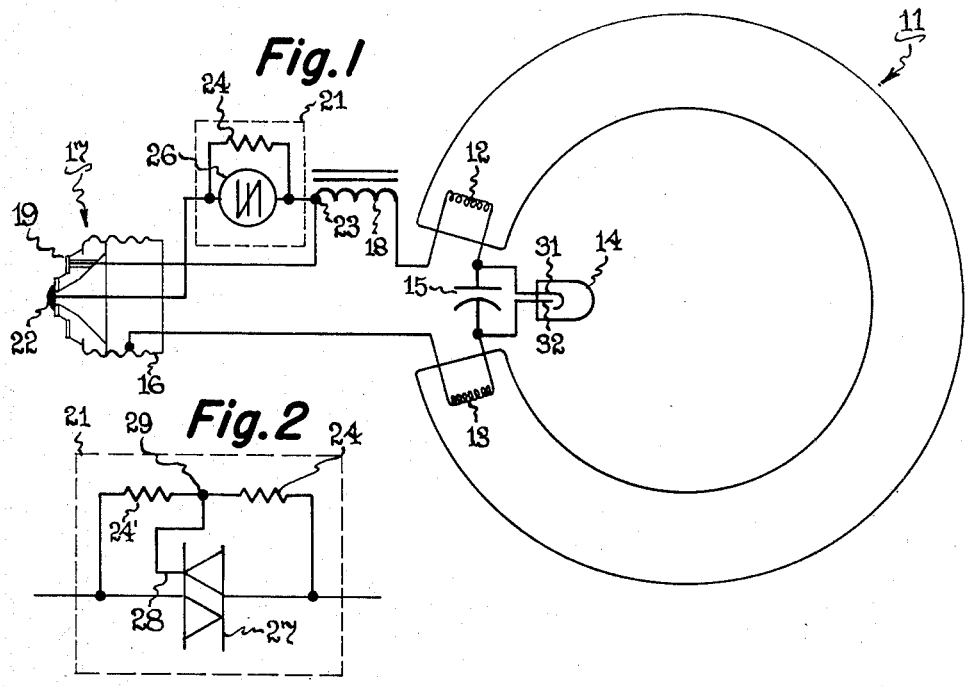
Fig. 1
11
12
13
14
15
16
17
18
19
21
22
23
24
26
31
32
Fig. 2
21
24
24'
27
28
29
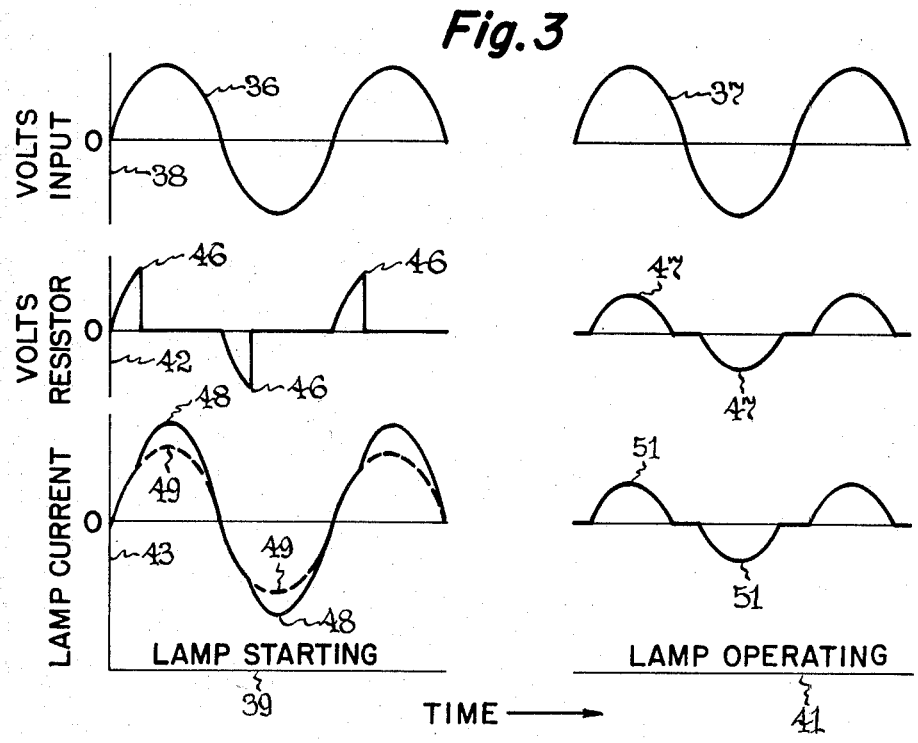
Fig. 3
VOLTS INPUT
VOLTS RESISTOR
LAMP CURRENT
0
36
37
38
46
47
42
48
49
43
51
LAMP STARTING
LAMP OPERATING
39
41
TIME

FLUORESCENT LIGHT UNIT WITH DUAL LIGHT LEVELS

CROSS-REFERENCES TO RELATED APPLICATIONS

Ser. No. 218,042, Charles E. Beck, "Fluorescent Light Unit with Dual Light Levels", filed concurrently herewith and assigned the same as this invention.

Ser. No. 218,020, Donald E. Magai, "Fluorescent Light Unit with Dimmable Light Level", filed concurrently herewith and assigned the same as this invention.

Ser. No. 47,985, Rudolph Metoff, "Circular Fluorescent Lamp Unit", filed June 13, 1979 and assigned the same as this invention.

BACKGROUND OF THE INVENTION

The invention is in the field of light units, such as screw-in circular fluorescent lights, and light units having selectable light levels such as bright and dim.

Three-way incandescent light bulbs have been popular for many years, for use in situations where differing light levels are desirable under differing conditions, and to conserve electrical power consumption by adjusting the light level to the lowest value suitable for the needed visual task. Fluorescent lamp units are more electrically efficient than incandescent lamps, and ways have been proposed for providing multiple-light level fluorescent lamp units. For example, U.S. Pat. Nos. 2,350,462 to Johns, 2,652,483 to Laidig, and 4,178,535 to Miller, disclose ways of providing selectably different light levels for circular fluorescent lights by inserting different reactive ballast elements, or different transformer winding turns, in series with the lamp bulbs. The general idea of a screw-in ballasted fluorescent lamp unit has been known, for example, by the disclosure in U.S. Pat. Nos. 2,320,424 to Gates and 2,817,004 to Baumgartner.

SUMMARY OF THE INVENTION

Objects of the invention are to provide a feasible and low-cost multiple light level fluorescent lamp unit.

The invention comprises, briefly and in a preferred embodiment, a fluorescent light unit having a fluorescent lamp bulb (such as a circular type), a starter switch connected between the bulb's cathodes, a reactor ballast selectively connected in series with the lamp bulb for high-level light output, and a resistor selectively connected in series with the reactor to provide low-level light output, and a bilateral switch device connected in parallel with the resistor so as to be conductive during portions of lamp starting current half-cycles at low level, and non-conductive during normal lamp operation, to facilitate lamp starting at low-level light setting.

BRIEF DESCRIPTION OF THE DRAWING

FIG. 1 is an electrical diagram of a preferred embodiment of the invention.

FIG. 2 shows an alternative embodiment of a portion of FIG. 1.

FIG. 3 is a graphical plot of voltage and current during starting and operation of the light unit at low light level.

DESCRIPTION OF THE PREFERRED EMBODIMENTS

As shown in FIG. 1, a fluorescent light bulb 11, preferably of a circular type known as Circline, is provided with cathodes 12 and 13 within the bulb and near the ends thereof. A conventional glow-starter switch 14 is connected between an end of each of the cathodes 12 and 13 and a capacitor 15 is connected across the starter 14 as is conventional. The remaining end of cathode 13 is electrically connected to the threaded shell 16 of a conventional three-way lamp screw-base 17. The remaining end of cathode 12 is connected via a ballast reactor 18 to a terminal such as the ring terminal 19 of the base 17. The reactor 18 has a value to cause "high-level" light output to be produced by the bulb 11 when electrical power is applied, via a conventional three-way lamp socket, to the shell 16 and ring terminal 19 of base 17. A "low-level" light circuit 21 is connected between the center "button" terminal 22 of the base 17 and the end 23 of reactor 18 which is connected to the ring terminal 19. In FIG. 1, the low-light level circuit 21 comprises a ballast resistor 24 connected between the center base terminal 22 and the reactor end 23, and also comprises a SIDAC bidirectional diode thyristor switch 26 connected in parallel with the resistor 24. A SIDAC device is described in U.S. Pat. No. 3,866,088 to Kaneda et al. In the FIG. 2 alternative low-level ballast, a Triac switch device 27 replaces the SIDAC of FIG. 1, and has a gate electrode 28 connected to a tap 29 of the ballast resistor 24' or to an equivalent junction 29 of resistor 24 and other resistor 24. Other alternative switch devices and circuits can be employed provided they function properly in the low-level ballast 21 as will be described with reference to FIG. 3. Preferably the ballast resistor 24 is a positive temperature coefficient type of which the resistance rises with temperature increase due to current therethrough. The low light level circuit 21 may be placed in the central hub of the light unit disclosed in the above-referenced Metoff patent application, along with the reactor 18, the 3-way base 17 being attached to the end of the hub. The lamp 11, starter switch 14, and reactor 18 may be the same as disclosed in Metoff.

When the screw base 17 is inserted in a conventional three-way socket the shell 16 is connected to one side of the a.c. electrical power. When the socket switch is in the "off position", no power is applied to either the ring terminal 19 nor the center terminal 22, and no light is produced. When the socket switch is turned to its next (first) position, electrical power is provided to the ring terminal 19 (and to the low-light filament of a conventional incandescent 3-way bulb). In the next (second) switch position, power is applied to the center terminal 22 (and to a second and brighter filament of a conventional 3-way bulb, for "medium" light). The third switch position connects electrical power to both the ring terminal 19 and the center terminal 22 (so that both filaments of a 3-way incandescent bulb light up resulting in "high" light level). The next socket switch position is again "off".

When a two-level light system is connected to a three-way lamp socket, as in the present invention, there is a choice available in light-level sequence. As shown and disclosed herein, the light-level sequence of light bulb 11 is "off-high-low-high-off", because the first socket switch position activates the ring contact 19 and operates the bulb 11 on "high" via reactor 18; the second socket switch position activates the center terminal 22 and operates the bulb 11 on "low" via the series-connected reactor 18 and resistor 24; and the third socket switch position activates both the ring terminal 19 and center terminal 22, again operating the bulb 11 on "high" via the reactor 18 (the "low" impedance 21 being shorted out between terminals 19 and 22); the next switch position is again "off". This light level sequence is preferred by many people because the light level changes at each switch position and thus something is seen to change in light level, indicating proper functioning. Alternatively, if the wiring connections were interchanged at the base terminals 19 and 22, the light-level sequence would be "off-low-high-high-off", and some people might suspect something wrong with no change in light level between the second and third switch positions.

The lamp unit, in each of its "high" and "low" light levels, functions in two sequential conditions: starting and operating. When the unit is turned on at "high" light level, via a-c voltage applied across the shell 16 and the ring terminal 19, voltage is applied to the lamp bulb cathodes 12, 13, and across the glow-starter switch 14, which causes gas (such as argon or neon) in the switch 14 to glow, and the heat thereof causes one or both of bimetal contacts 31, 32 to close together, causing current to flow through and heat the cathodes 12, 13 to electron-emitting temperature. While the bimetal starting switch contacts 31, 32 are thus closed, the gas ceases to glow and the contacts cool and open apart in about a second, causing an inductive voltage "kick" to occur in the reactor 18 which causes the heated cathodes 12, 13 to emit electrons and start an electrical discharge in the gas (mercury, and argon or other starting gas) in the bulb which excites the phosphor on the inner bulb wall and generates visible light.

Starting the lamp 11 in the high-level condition with the reactor 18 in series with the bulb 11 as just described, is conventional and no problem. However, starting the bulb 11 in the low-level condition with the resistor 24 (or another additional impedance such as an inductor or a capacitor) in the circuit, may cause problems in reliable starting of the lamp 11 due to insufficient pre-heating current in the cathodes 12, 13 to bring their heat up to sufficient value to ensure electron-emissive discharge starting in the lamp when the starting switch 14 opens to induce lamp starting. Also, insufficient preheating of the cathodes at the instant of lamp starting (assuming the lamp starts) can cause electrons to be "pulled" from the cathode's electron emissive material by the starting voltage electrical field, thus damaging the electron emissive material.

In accordance with the invention, the SIDAC 26, Triac 27, or equivalent device or circuit, connected across the "low" light level impedance 24, insures adequate pre-starting current in the cathodes 12, 13, and is inactive when the light bulb 11 is operating normally.

FIG. 3 shows how the invention starts the light bulb 11 on the low-light level setting, when the socket center terminal 22 is activated and the low-light level circuit 21 is in series with the bulb 11. The upper curves 36, 37 illustrate the input voltage 38 across the socket terminals 16, 22 during low-level light condition, divided in time into lamp starting time 39 and lamp operating time 41. The next curve shows voltage 42 across the low-light level impedance 24, as determined by the bilateral switch 26, 27, etc., during the lamp starting and lamp operating, and the third curve shows the lamp current 43 during lamp starting and lamp operating. The bilateral switch device 26, 27, etc. is chosen or biased and adjusted, to become conductive when the voltage across the impedance 24 reaches a point 46 during each half-cycle of the starting period (while the starting switch 14 is closed and before it opens for normal lamp operation) which point is slightly higher in voltage than the normal operating peak voltage 47 of the resistor 24 when the lamp 11 is operating normally. By thus becoming conductive each half-cycle during the lamp starting period, the switch device 26, etc. periodically short-circuits the low-level ballast impedance 24 and causes a higher-current 48 to flow through the cathodes 12, 13 during starting than would be the current 49 during each starting half-cycle without the bilaterial device 26, 27, etc., and this higher starting current causes the cathodes 12, 13 to heat faster and hotter during the starting period (of about one second, for example) to insure reliable starting of the lamp bulb 11 at the low-light condition. The low-light level starting current 48 in the lamp cathodes 12, 13 can, in accordance with the invention, be approximately the same, and thus preheat the cathodes to approximately the same temperature by the time the starting switch 14 opens to start the lamp, as is the case in high-light level starting; the difference is represented by the small areas under the curves 46 which represent the small values of voltage drop in the resistor 24 during low-level starting. Further in accordance with the invention, the reactor 18 is in electrical series with the impedance 21 to provide an additional function of limiting preheat cathode current to a safe value during the intervals when the bilateral switch 26, 27 etc. is a short circuit or low impedance across the low-light level ballast device 24. If the starting switch 14 remains closed for one second, which is typical, for causing preheating of the cathodes, there will be 60 cycles of the voltages and current 36, 46, 48 during lamp starting (assuming a 60 Hz power source). For clarity, FIG. 3 shows only one and a half of these cycles.

After the lamp 11 starts and is operating, its discharge current 51 causes a voltage drop 47 across the ballast resistor 24 having a peak value that is lower than the switch-on voltage point 46 of the bilateral switch device 26, etc., so that this switch device is inoperative and the lamp 11 is biased by the resistor 24 and reactor 18. The slight discontinuities at the zero crossings of curves 47 and 51 are caused by a slight time delay in starting of the lamp's discharge at each half-cycle of operation. Optimum values and characteristics of the low-light level ballast resistor 24 and the bilateral switch device 26, etc. can be chosen by calculation or by experiment, with respect to the desired value of low-light level lamp current 51.

The invention has been found to achieve its objectives of providing a feasible low-cost multiple light level fluorescent lamp unit, and such a lamp unit in which both the high-light level circuit and the low-light level circuit can be provided in the central ballast hub unit disclosed in the above-referenced Metoff patent application. Also, the bilateral switch 26 or 27, performs a useful function in addition to facilitating lamp starting at low light level. In the even that the starter 14 should stick in its closed condition, or at the end of useful lamp life when a gas discharge cannot occur and the starter 14 keeps trying to start the lamp and thus repeatedly closes, the relatively large current through resistor 24 over a period of time could cause it to heat to an undesirable temperature; however, the bilateral switch 26 or 27 will bypass much of this current and prevent excessive heating of the resistor, and the reactor 18 will limit the current to a safe value for the circuit.

While preferred embodiments and modifications of the invention have been shown and described, various other embodiments and modifications thereof will become apparent to persons skilled in the art and will fall within the scope of the invention as defined in the following claims.

I claim:

1. A multiple light level gas discharge light unit, such as a fluorescent light unit, for operation from a-c electrical power, comprising a gas discharge light bulb having a pair of cathodes therein, a three-terminal base, means connecting a first end of one of said cathodes to a first terminal of said base, a ballast reactor connected between a first end of the other of said cathodes and a second terminal of said base and adapted to ballast said light bulb at a relatively high light level, and ballast circuit means connected between said second terminal and a third terminal of said base and adapted to ballast said light bulb at a relatively low light level in cooperation with said ballast reactor, said ballast circuit means comprising an impedance connected between said second and third base terminals, and bilateral switch means connected in parallel with said impedance, and said light unit including a starter switch connected between the remaining ends of said cathodes and adapted to close for a period of time when electrical power is applied to said base, in order to cause preheat current to flow through said cathodes, and thereafter be in open condition when said light bulb is operating, said bilateral switch means being adapted to be conductive during at least a portion of each electrical power half-cycle during said preheating of the filaments for said relatively low light level operation and thereafter being non-conductive during low light level operation of the lamp.

2. A light unit as claimed in claim 1, in which said impedance is a resistance.

3. A light unit as claimed in claim 2, in which said resistance has a positive temperature coefficient of resistance.

4. A light unit as claimed in claim 1, in which said bilateral switch means is a SIDAC device.

5. A light unit as claimed in claim 1, in which said bilateral switch means is a biased Triac device.

6. A light unit as claimed in claim 1, in which said bilateral switch means is connected to become conductive during each half cycle of preheat current in response to the voltage drop across said impedance reaching a given value during each said half cycle, said given voltage value being greater than the peak a-c voltage drop across said impedance during low-light level operation of said light bulb, whereby said bilateral switch means is non-conductive during said low-light level operation.

* * * * *